US011730292B2

(12) United States Patent
Ambuske et al.

(10) Patent No.: US 11,730,292 B2
(45) Date of Patent: Aug. 22, 2023

(54) SELF-STOWING PILLOW

(71) Applicant: Hest Corporation, Seattle, WA (US)

(72) Inventors: Aaron Alan Ambuske, Seattle, WA (US); Brian Fletcher, Issaquah, WA (US); Hedvig von Beetzen, Seattle, WA (US); Mirona Motoc, Seattle, WA (US); Zac West, Seattle, WA (US)

(73) Assignee: HEST CORPORATION, Seattle, WA (US)

( * ) Notice: Subject to any disclaimer, the term of this patent is extended or adjusted under 35 U.S.C. 154(b) by 162 days.

(21) Appl. No.: 17/330,356

(22) Filed: May 25, 2021

(65) Prior Publication Data

US 2021/0369019 A1 Dec. 2, 2021

Related U.S. Application Data

(60) Provisional application No. 63/031,918, filed on May 29, 2020.

(51) Int. Cl.
*A47G 9/10* (2006.01)

(52) U.S. Cl.
CPC .... *A47G 9/1027* (2013.01); *A47G 2009/1018* (2013.01)

(58) Field of Classification Search
CPC ..... A47G 9/10; A47G 9/1009; A47G 9/1027; A47G 9/1072; A47G 9/1081; A47G 2009/1018
See application file for complete search history.

(56) References Cited

U.S. PATENT DOCUMENTS 941,043 A * 11/1909 Powell ..... A47G 9/10 5/640
4,756,035 A * 7/1988 Beier ..... A47G 9/1081 5/643
4,768,247 A * 9/1988 Beier ..... A47G 9/0253 5/636
6,189,168 B1 * 2/2001 Graebe ..... A47G 9/1027 5/490
9,913,551 B1 * 3/2018 Baker ..... A47G 9/04
(Continued)

FOREIGN PATENT DOCUMENTS

CN 209269235 U 8/2019
JP 444936 Y 2/1969
KR 200394466 Y1 9/2005

OTHER PUBLICATIONS

Extended European Search Report dated Oct. 27, 2021 for co-pending European Patent Application No. 21176551.6; 8 pages.

*Primary Examiner* — David R Hare
*Assistant Examiner* — George Sun
(74) *Attorney, Agent, or Firm* — Lowe Graham Jones PLLC

(57) ABSTRACT

A pillow includes a first lobe, a second lobe, and a third lobe extending outwardly from a central node and containing cushioning filling. A closure mechanism extends around perimeter of the first and second lobe. The third lobe is covered by the first and second lobe in a stowed position and not covered in a sleeping position. Portions of the first and second lobe exposed in the stowed position are covered by durable fabric. A Y-shaped inner pillow case may contain the filling and be positioned within the lobes. The filling may include an air bladder with a valve exposed in the stowed position.

17 Claims, 9 Drawing Sheets

(56) References Cited

U.S. PATENT DOCUMENTS

| | | | | |
|---|---|---|---|---|
| 11,419,439 | B1 * | 8/2022 | Leach | A47G 9/0253 |
| 2004/0019972 | A1 * | 2/2004 | Schecter | A47G 9/10 5/636 |
| 2006/0031996 | A1 * | 2/2006 | Rawls-Meehan | A47C 27/15 5/724 |
| 2007/0044239 | A1 * | 3/2007 | Leifermann | A47G 9/1081 5/636 |
| 2007/0107131 | A1 * | 5/2007 | Fux | A47G 9/10 5/636 |
| 2007/0245493 | A1 * | 10/2007 | Leifermann | A47G 9/0253 5/636 |
| 2007/0261170 | A1 * | 11/2007 | Hollander | A47G 9/0238 5/636 |
| 2013/0019409 | A1 * | 1/2013 | Blazar | A47G 9/1027 5/644 |
| 2014/0223664 | A1 * | 8/2014 | Kanbar | A47G 9/10 5/636 |
| 2015/0173535 | A1 * | 6/2015 | Reese | A47G 9/0253 5/490 |
| 2017/0020312 | A1 * | 1/2017 | Davis | A47G 9/10 |
| 2017/0231410 | A1 * | 8/2017 | Chon | A47G 9/10 5/640 |
| 2017/0347815 | A1 * | 12/2017 | Moeller | A47G 9/10 |
| 2018/0325291 | A1 * | 11/2018 | Holbrook | A47G 9/04 |
| 2019/0021526 | A1 * | 1/2019 | Deng | A47G 9/1081 |
| 2019/0075948 | A1 * | 3/2019 | Reuben | A47G 9/0253 |
| 2019/0298088 | A1 * | 10/2019 | Li | A47G 9/10 |
| 2019/0298089 | A1 * | 10/2019 | Abdul | A47G 9/1027 |
| 2020/0237122 | A1 * | 7/2020 | Hafeznezami | A47G 9/10 |
| 2021/0037995 | A1 * | 2/2021 | Dompierre | A47C 31/10 |
| 2021/0127867 | A1 * | 5/2021 | Lee | A47C 7/383 |

* cited by examiner

SELF-STOWING PILLOW

PRIORITY CLAIM

This application claims priority to U.S. Provisional Application Ser. No. 63/031,918 filed May 29, 2020 and entitled PILLOW, which is hereby incorporated herein by reference.

FIELD OF THE INVENTION

This application relates to pillows and, more particularly, to pillows for use when traveling.

BACKGROUND OF THE INVENTION

Items used when traveling are often adapted relative to their conventional counterparts to make them smaller and more portable. Often, this results in compromising the performance of the item. Although this may be acceptable for some things, a traveler may not be willing to accept compromises in sleeping arrangements. This is problematic inasmuch as conventional blankets, pillows, and mattresses are quite bulky.

It would be an advancement in the art to provide a pillow that functions as a conventional pillow while also being compact.

SUMMARY OF THE INVENTION

In one aspect of the invention, a pillow includes a first lobe, a second lobe, and a third lobe extending outwardly from a central node. The third lobe and at least one of the first lobe and the second lobe contain cushioning filling. A perimeter of the first lobe has a first closure portion secured thereto. A perimeter of the second lobe has a second closure portion secured thereto and selectively engageable with the first closure portion. The third lobe may be arranged in a sleeping position or a stowed position. The third lobe is positioned between the first lobe and the second lobe when in the stowed position and is not positioned between the first lobe and the second lobe when in the sleeping position.

The third lobe may be exposed when in the sleeping position and covered by the first lobe and the second lobe when in the stowed position. In some embodiments, a first portion of the first lobe and second lobe is exposed and the third lobe is not exposed when the third lobe is in the stowed position and the first closure portion is engaged with the second closure portion, the first portion being covered with a first material. A second portion of the first lobe and second lobe and the third lobe are exposed when the third lobe is in the sleeping position and the first closure portion is engaged with the second closure portion, the second portion being covered with a second material. The first material may be any one or more of less stretchy, less flexible, and more durable than the second material. For example, the first material may be all of less stretchy, less flexible, and more durable than the second material.

The first material may define a zippered opening for inserting the cushioning filling. In some embodiments, both of the first lobe and the second lobe contain the cushioning filling. In some embodiments, the pillow may include a Y-shaped inner pillow case containing the cushioning filling and positioned within the first lobe, second, lobe, and third lobe.

In some embodiments, at least a portion of the cushioning filling is an air bladder. A valve is coupled to the air bladder, a portion of the valve protruding outwardly from the first lobe, the valve being exposed when the third lobe is in the stowed position and the first closure portion is engaged with the second closure portion and covered between the first lobe and the second lobe when the third lobe is in the sleeping position and the first closure portion is engaged with the second closure portion. The filling material may be any of a sheet of foam, shredded foam, and down.

In some embodiments, a method includes providing a pillow including a first lobe, a second lobe, and a third lobe extending outwardly from a central node, wherein the third lobe and at least one of the first lobe and the second lobe contain cushioning filling. A closure mechanism may be secured around a perimeter of the first lobe and a perimeter of the second lobe. The method may include closing the closure mechanism with the third lobe in a stowed position, the third lobe contained within the first lobe, second lobe, and closure mechanism in the stowed position.

In some embodiments, the method includes opening the closure mechanism with the third lobe in the stowed position and closing the closure mechanism with the third lobe in a sleeping position, the third lobe being exposed and not contained within the first lobe, second lobe, and closure mechanism when in the sleeping position.

In some embodiments, a first portion of the first lobe and second lobe is exposed and the third lobe is not exposed when the third lobe is in the stowed position and the closure mechanism is closed, the first portion being covered with a first material. In some embodiments, a second portion of the first lobe and second lobe and the third lobe are exposed when the third lobe is in the sleeping position and the closure mechanism is closed, the second portion being covered with a second material. The first material may be any one or more of less stretchy, less flexible, and more durable than the second material. The first material may be all of less stretchy, less flexible, and more durable than the second material.

In some embodiments, the closure mechanism is a zipper. In some embodiments, both of the first lobe and the second lobe contain the cushioning filling. In some embodiments, a Y-shaped inner pillow case containing the cushioning filling and positioned within the first lobe, second, lobe, and third lobe.

In some embodiments, at least a portion of the cushioning filling is an air bladder. The method may further include deflating the air bladder. A valve may be coupled to the air bladder. A portion of the valve may protrude outwardly from the first lobe and be exposed when the third lobe is in the stowed position and the first closure portion is engaged with the second closure portion. The valve may be covered between the first lobe and the second lobe when the third lobe is in the sleeping configuration. The method may include deflating the air bladder using the valve.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
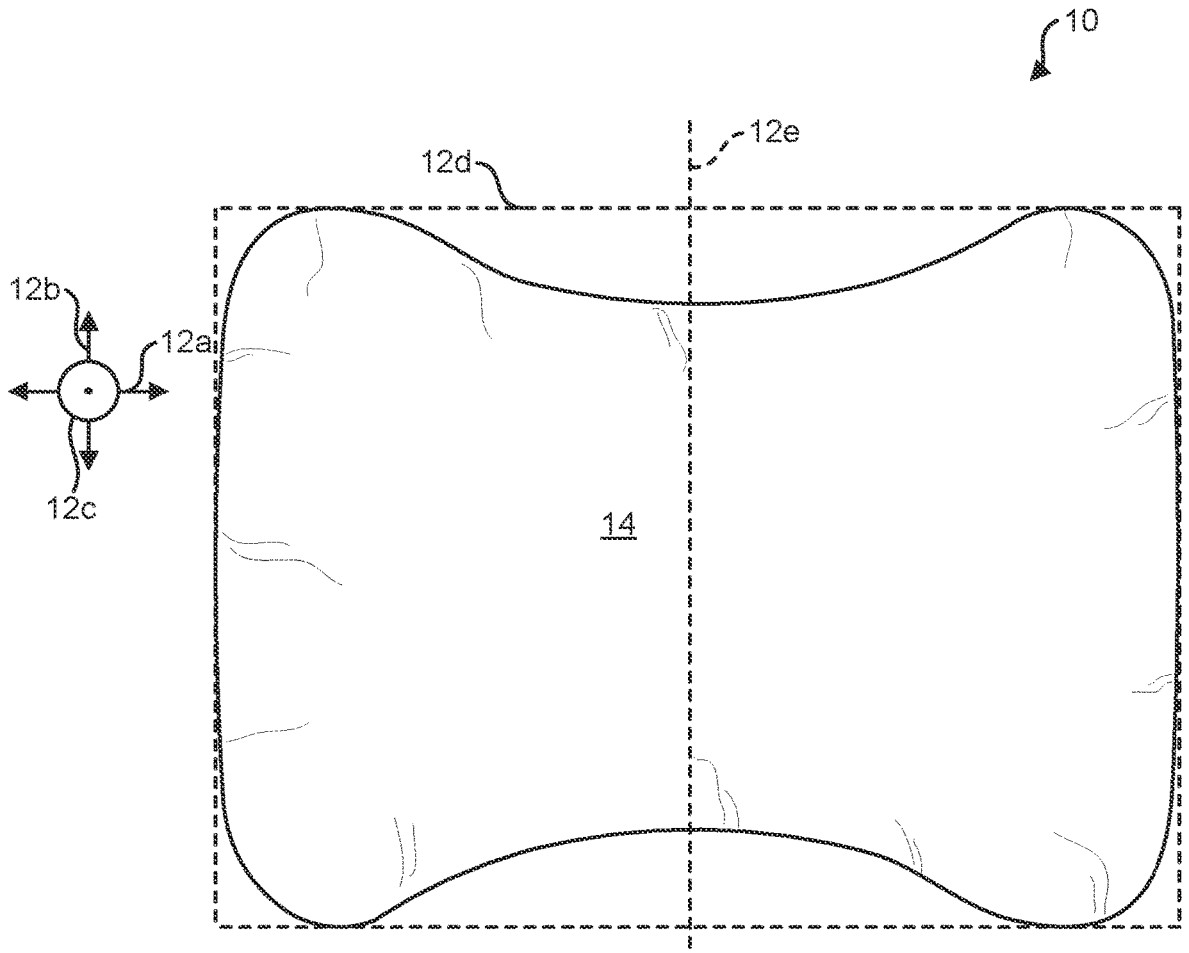
FIG. 1 is a top view of a pillow in a sleeping configuration in accordance with an embodiment of the present invention.

Referring to FIG. 1, a pillow 10 may be understood with respect to a horizontal direction 12*a*, longitudinal direction 12*b*, and a vertical direction 12*c* that are all mutually perpendicular to one another. The directions 12*a*, 12*b*, 12*c* are recited to facilitate understanding of relative positions of features of the pillow 10 but do not need to correspond to the actual orientation of the pillow 10 during use.

The pillow 10 when in the illustrated sleeping configuration has a generally rectangular shape, or a bounding rectangle 12*d* may be defined in a plane parallel to the horizontal direction 12*a* and longitudinal direction 12*b* direction 12*a*, the bounding rectangle 12*d* being a smallest rectangle containing the pillow 10 with the pillow 10 resting on a support surface parallel to the plane and undeformed by any external force other than gravity. The horizontal direction 12*a* may be defined as parallel to the longest edges of the bounding rectangle, the longitudinal direction may be defined as parallel to the shortest edges of the bounding rectangle 12*d* (or edges other than those used to define the horizontal direction 12*a* where the bounding rectangle is a square). The vertical direction 12*c* is perpendicular to the directions 12*a*, 12*b* and corresponds to the amount of loft of the pillow 10.

As is apparent in FIG. 1, the pillow may have a non-rectangular shape, including such non-angular features as rounded corners or narrowing toward the center of the pillow. In other embodiments, the pillow has a conventional rectangular shape. The shape shown in FIG. 1 may be the shape of the pillow containing filling. The filling may include cushioning material such as one or more sheets of foam (e.g., polyurethane or latex foam), shredded foam, polyester fibers (FIBERFILL), down feathers, or other cushioning material.

FIG. 1 illustrates the sleeping case 14 of the pillow 10. The reverse of the pillow 10 (facing away from the viewer) may have the same shape and configuration and also form part of the sleeping case 14. The sleeping case 14 may be made of a natural or synthetic fiber such as nylon, polyester, cotton, linen, or other material known in the art for use in making pillow cases. In an exemplary embodiment, the sleeping case 14 is made of a stretchy woven nylon material.

Figure 2:
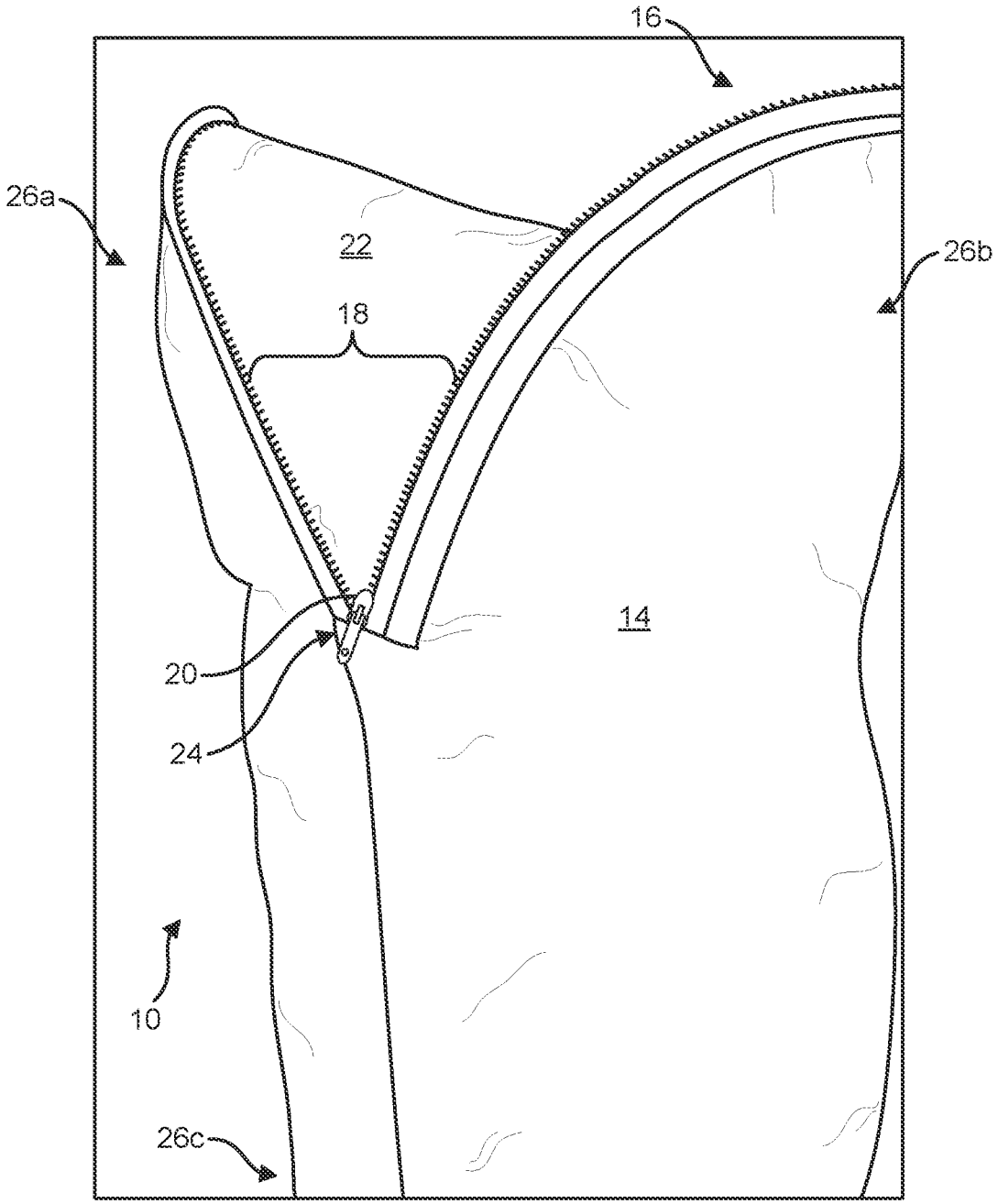
FIG. 2 is an isometric view of the pillow transitioning from the sleeping configuration to a stowed configuration.

Referring to FIG. 2, while still referring to FIG. 1, a portion of the perimeter of the sleeping case 14 may define an opening 16. In the illustrated embodiment, this portion is a portion of the edge of the sleeping case 14 closest to the left edge of the bounding rectangle 12*d* in FIG. 1 and parts of the top and bottom edges extending away from the left edge, e.g., extending from the left edge between 40 and 60 percent of the length of the top and bottom edges. Stated differently, the perimeter of the sleeping case 14 defining the opening 16 may be positioned completely to one side of line 12*e* intersecting the pillow and parallel to the longitudinal direction 12*b*. This line 12*e* may be at the midpoint of the pillow 10 or rectangle 12*d* along the horizontal direction 12*a* or offset therefrom by up to 10 percent of the length of the pillow 10 or rectangle 12*d* along the horizontal direction 12*a*. In the illustrated embodiment, the line 12*e* is offset from the left edge of the pillow 10 or the bounding rectangle 12*d* along the horizontal direction 12*a* by an amount less than or equal to the length of the pillow 10 or bounding rectangle 12*d* in the horizontal direction 12*a*.

The opening 16 may have a zipper 18 fastened around its perimeter and a zipper pull 20 for closing the zipper 18 and the opening 16. The pillow 10 may have the configuration of FIG. 1 when the zipper 18 and opening 16 are closed. When the zipper pull 20 is used to open the zipper 18, a storage case 22 is exposed. In this and other instances described herein where zippers are recited securing edges of material to one another, other closure mechanisms may be used instead, such as a series of snaps, magnets, buttons, hook-and-loop fasteners, or other closure mechanisms disposed along the edges being secured together.

The storage case 22 may be made of a material that is some or all of more durable, less stretchy, and less flexible than the material forming the sleeping case 14. For example, the storage case 22 may be made of a non-stretchy woven nylon, which may be coated with polyurethane or other material to improve durability.

As is apparent in FIG. 2, with the opening 16 opened, the pillow 10 is Y-shaped. For example, nodes 24 may be defined at the ends of the opening 16 where the zipper pull 20 is located when the zipper 18 is either completely open or completely closed. Lobes 26*a*, 26*b*, and 26*c* may extend outwardly from these nodes 24. As is apparent, outward facing surfaces of the lobes 26*a*, 26*b* are covered with the sleeping case 14. Surfaces of the lobs 26*a*, 26*b* facing inwardly toward one another are covered with the storage case. Both surfaces of the lube 26*c* are covered with the sleeping case 14. Both lobes 26*a*, 26*b* may include filling material in some embodiments. In other embodiments, only one lobe 26*a* or 26*b* contains filling material.

Stated differently, the sleeping case is split between the top edge (left edge in FIG. 1), the split extending partially toward the bottom edge (right edge in FIG. 1). The inner surface of the split is formed by the storage case 22.

Figure 3:
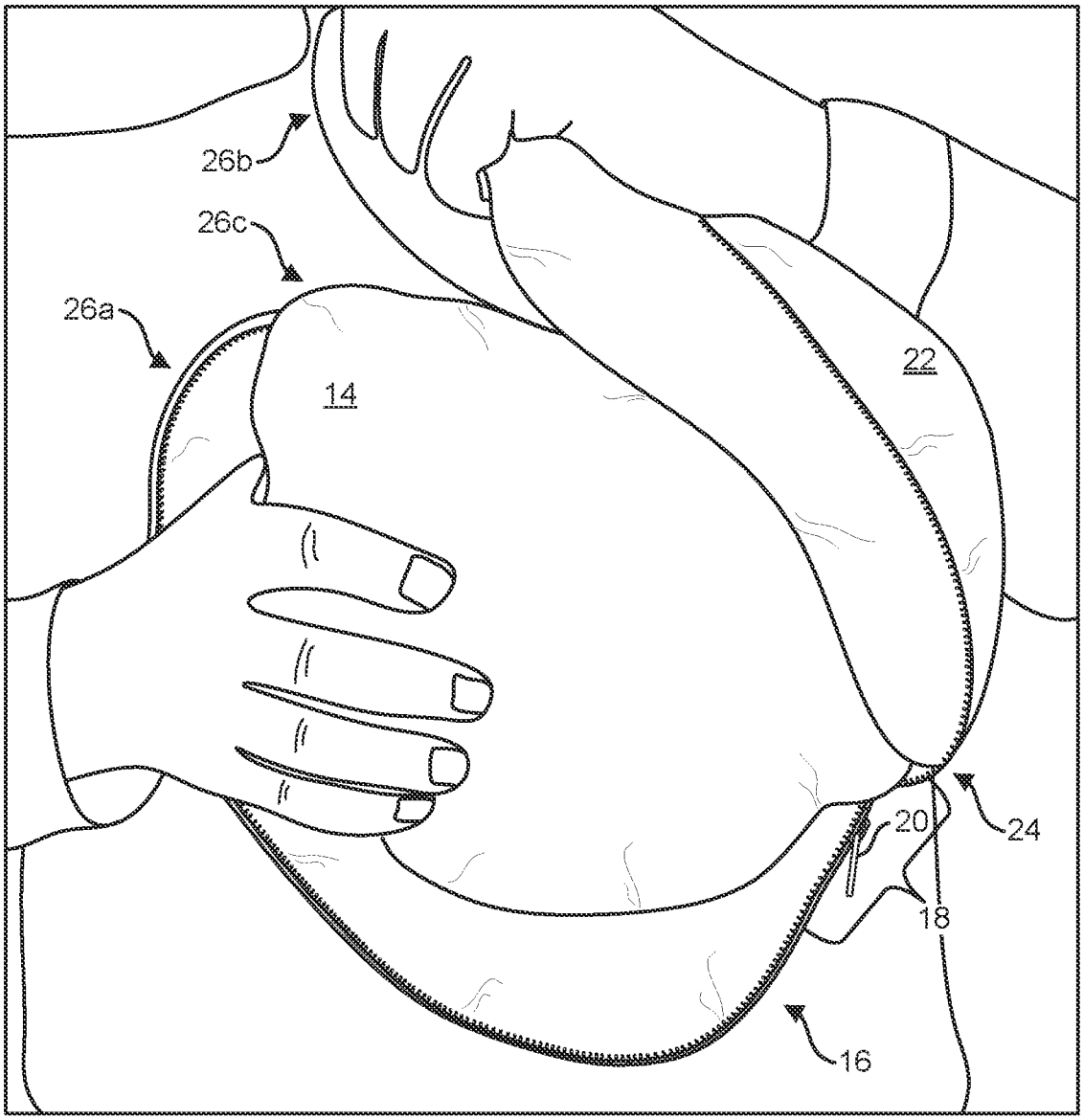
FIG. 3 is an isometric view of the pillow in a later stage of transitioning from the sleeping configuration to the stowed configuration in accordance with an embodiment of the present invention.

Referring to FIG. 3, for placement in a storage configuration, the lobes 26*a*, 26*b* are folded down over the lobe 26*c* such that the storage case 22 is facing outwardly. The surfaces of lobes 26*a*, 26*b* that are covered with the sleeping case 14 may be facing and contacting surfaces of the lube 26*c* covered with the sleeping case 14. Regardless of the position of the lobes, 26*a*, 26*b*, 26*c*, the filling of the pillow and the sleeping case 14 are placed such that they are enveloped by and contained within the storage case 22. The storage case 22 is preferably constructed of a more durable, stain, and water-resistant material that protects the pillow with the softer, more comfortable material of the sleeping case 14.

Figure 4:
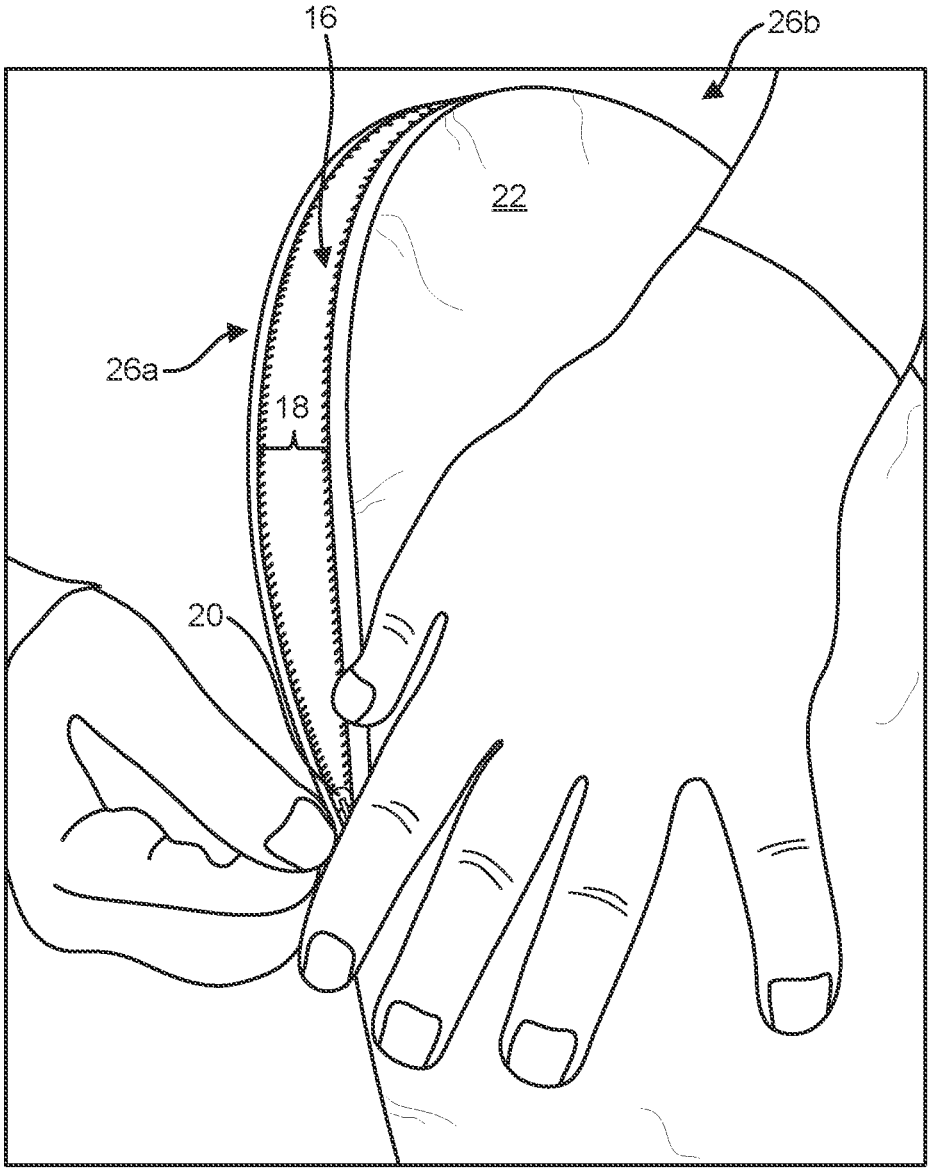
FIG. 4 is an isometric view of the closure mechanism being closed with the pillow in the stowed configuration in accordance with an embodiment of the present invention.

Referring to FIG. 4, the zipper pull 20 may then be used to close the opening 16 such that the zipper 18 and storage case 22 completely cover the pillow 10.

Figure 5:
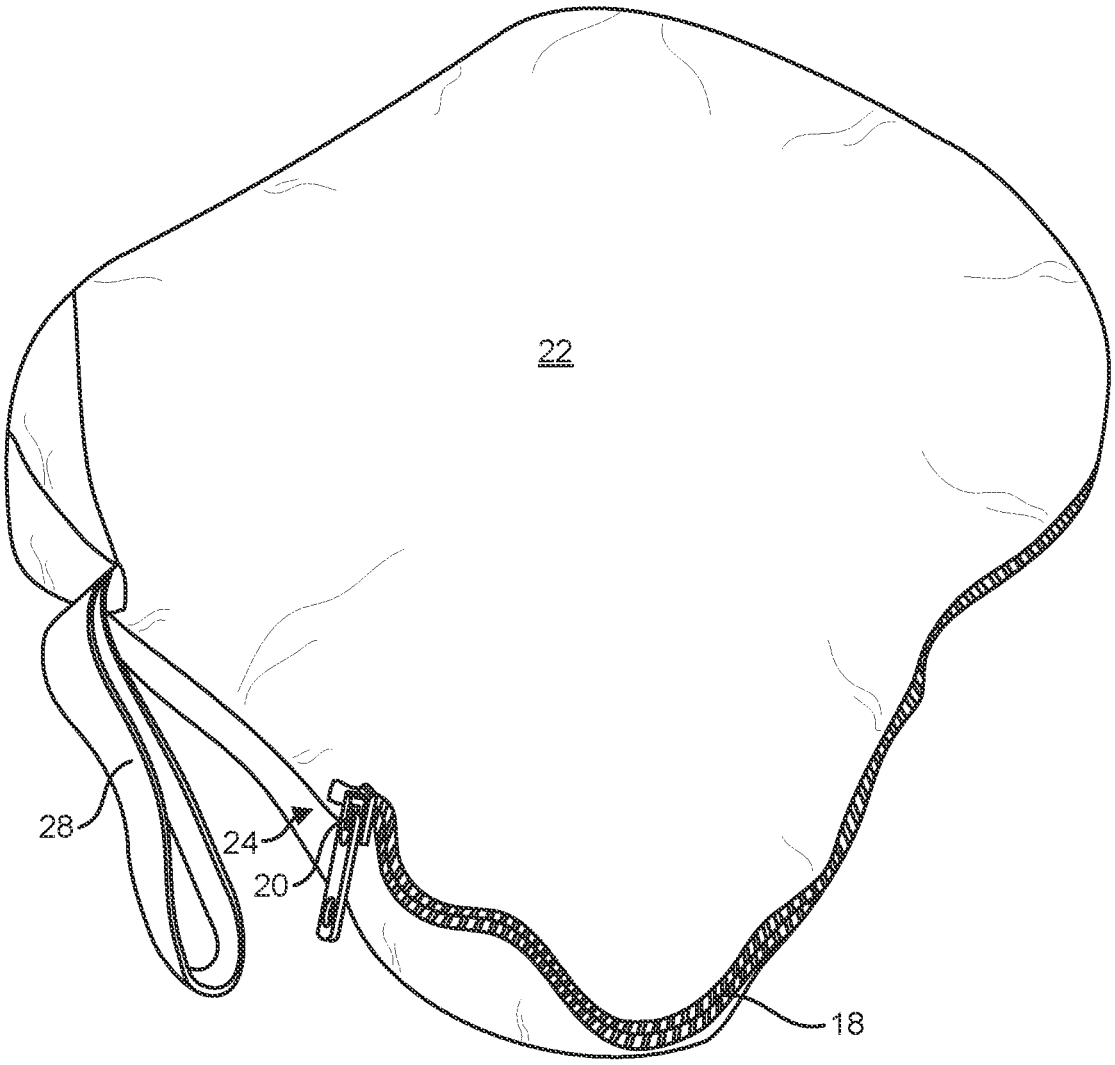
FIG. 5 is an isometric view of the pillow in the stowed configuration in accordance with an embodiment of the present invention.

Referring to FIG. 5, the storage case 22 may be made of a single sheet of material with the zipper 18 secured to portions of the edges of that sheet of material. The storage case 22 may be made of multiple pieces of material to form a pouch. A handle 30 may be secured to the storage case 22 to facilitate carrying of the pillow 10 when stowed.

Figure 6A:
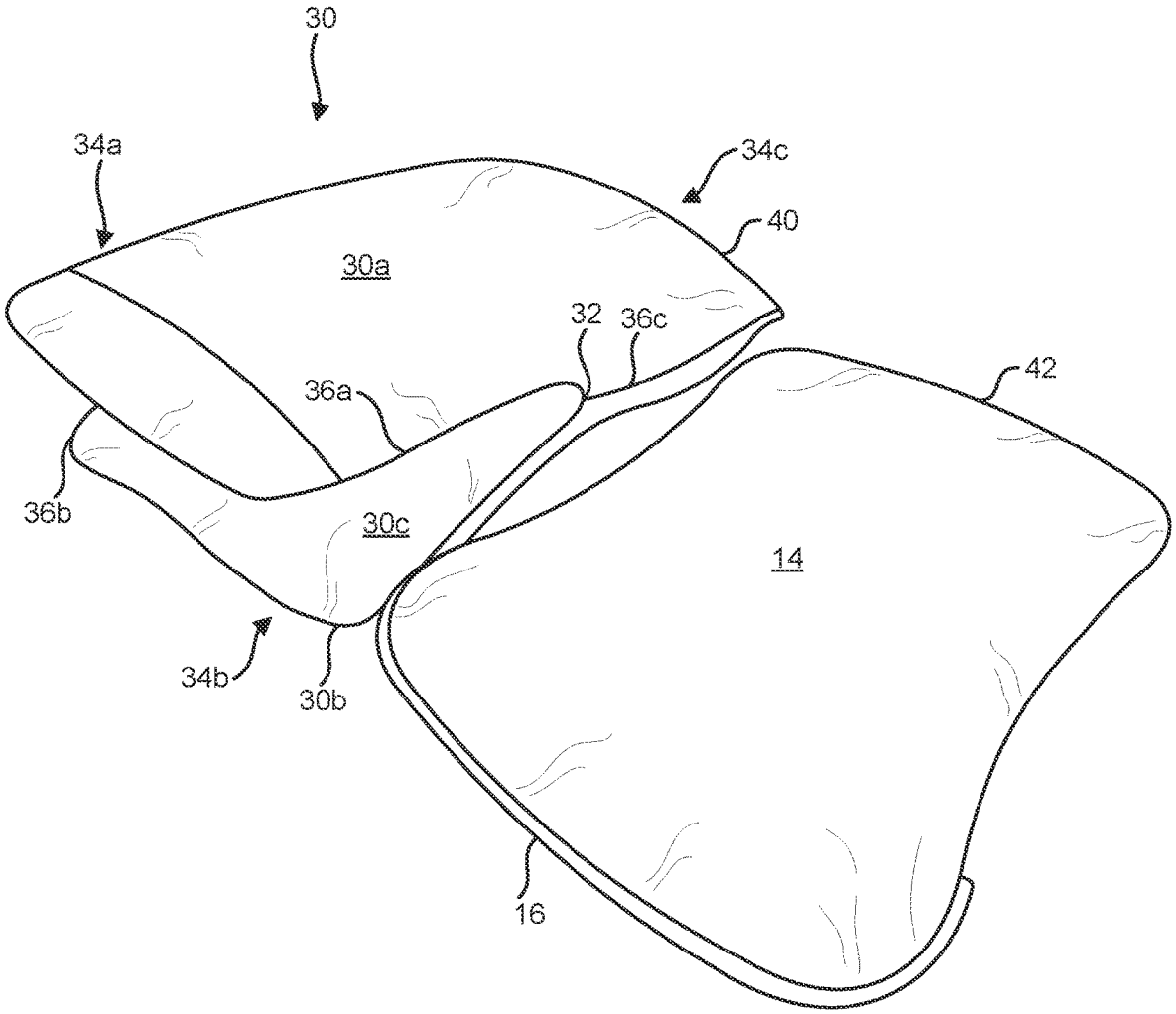
FIG. 6A is an isometric view showing an inner pillow case in accordance with an embodiment of the present invention.

Referring to FIG. 6A, some embodiments, loose filling material is simply contained within the storage case 22 and sleeping case 14. In other embodiments, an inner pillow case 30 may be used and contain the filling material. The inner pillow case 30 may also be Y-shaped with nodes 32 on either side and lobes 34*a*, 34*b*, 34*c* extending outwardly from the nodes 32 and fitting inside the nodes 26*a*, 26*b*, 26*c* as defined above. The side of the inner case 30 facing away from the viewer may have a mirrored configuration and define one of the nodes 32.

The inner case 30 may be of three-piece construction including a top piece 30*a*, bottom piece 30*b*, and inner piece 30*c*. The inner piece 30*c* is secured to the top piece 30*a* by seam 36*a* and to the bottom piece 30*b* by seam 36*b*. As is apparent, the seams 36*a*, 36*b* may extend substantially (e.g., within 3 mm) to the nodes 32. A right end portion of the top and bottom piece 30*a*, 30*b* are secured to one another by seam 36*c* substantially (e.g., within 3 mm) to the nodes 32.

The inner piece 30*c* is described as being a single piece but may also include two pieces, such as connected by a seam extending between the nodes 32. The nodes 34*a*, 34*b* are therefore defined by the top piece 30*a*, 30*b* and the inner piece 30*c* whereas the node 34*c* is defined by the top piece 30*a* and the bottom piece 30*b*.

The three-piece construction shown in FIG. 6A may also be used for constructing the sleeping case 14 and storage case 22, with the sleeping case 14 corresponding to the top piece 30*a* and bottom piece 30*b* and the storage case 22 corresponding to the inner piece 30*c*.

Access to the interior of the inner case 30 may be by means of a zipper along any of the seams 36*a*, 36*b*, 36*c*. For example, a zippered opening 40 may be placed along the seam 30*a* at the end of the lobe 34*a*. In a like manner, the inner case 30 may be inserted into the sleeping case 14 by means of a zippered opening 42 defined by the sleeping case 14, such as opposite the opening 16.

Figure 6B:
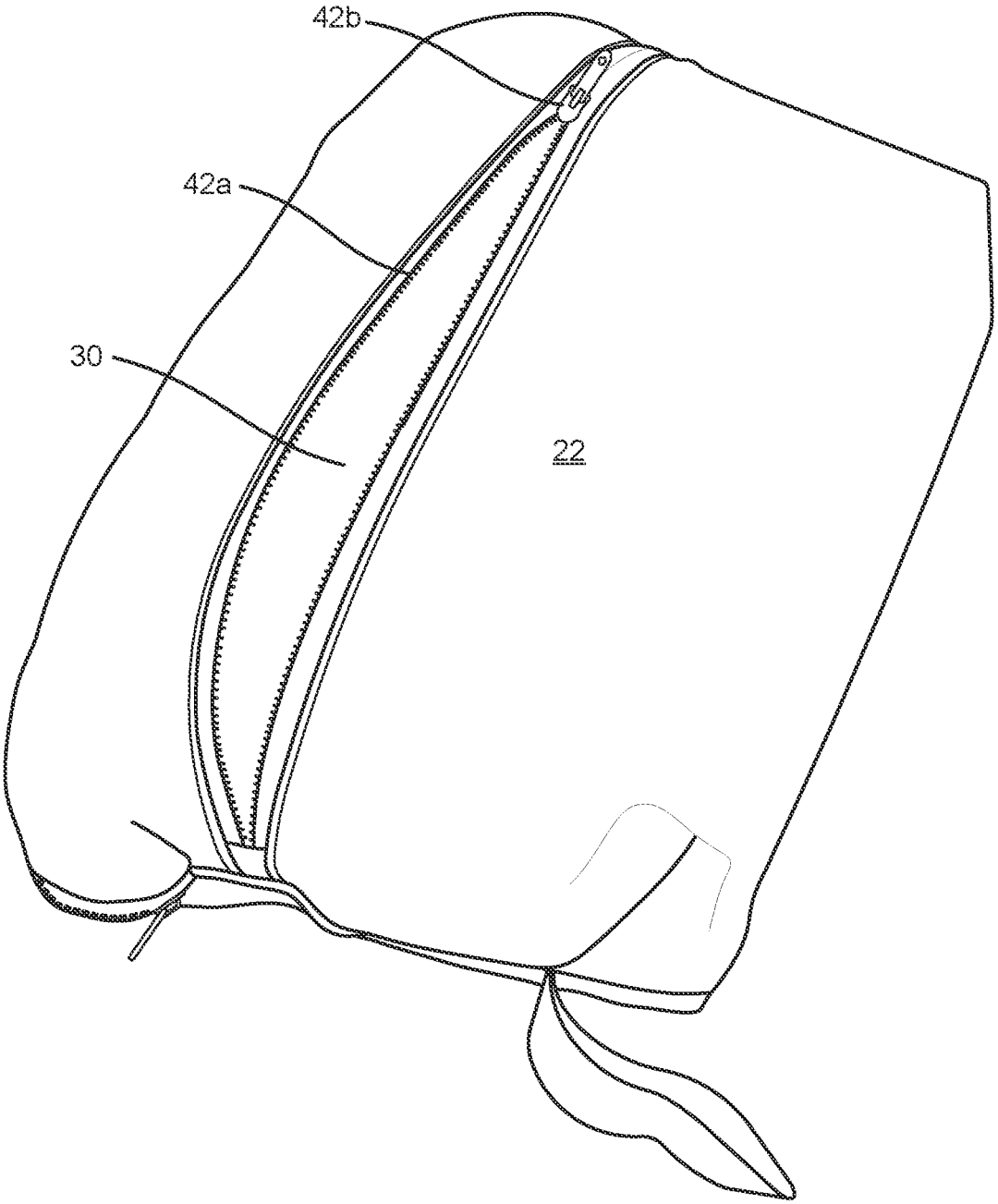
FIG. 6B is an isometric view showing an opening for inserting an inner pillow case in accordance with an embodiment of the present invention.

Referring to FIG. 6B, in some embodiments, a zippered opening 42*a* and corresponding zipper pull 42*b* are secured to the storage case 22. The inner case 30 may be inserted through this opening. However, when the pillow 10 is in a sleeping configuration (see FIG. 1), the inner case 30, zippered opening 42*a*, and zipper pull 42*b* are enclosed within the sleeping case thereby eliminating any discomfort that may be caused by the roughness of the zippered opening 42*a* and zipper pull 42*b*.

Figure 7:
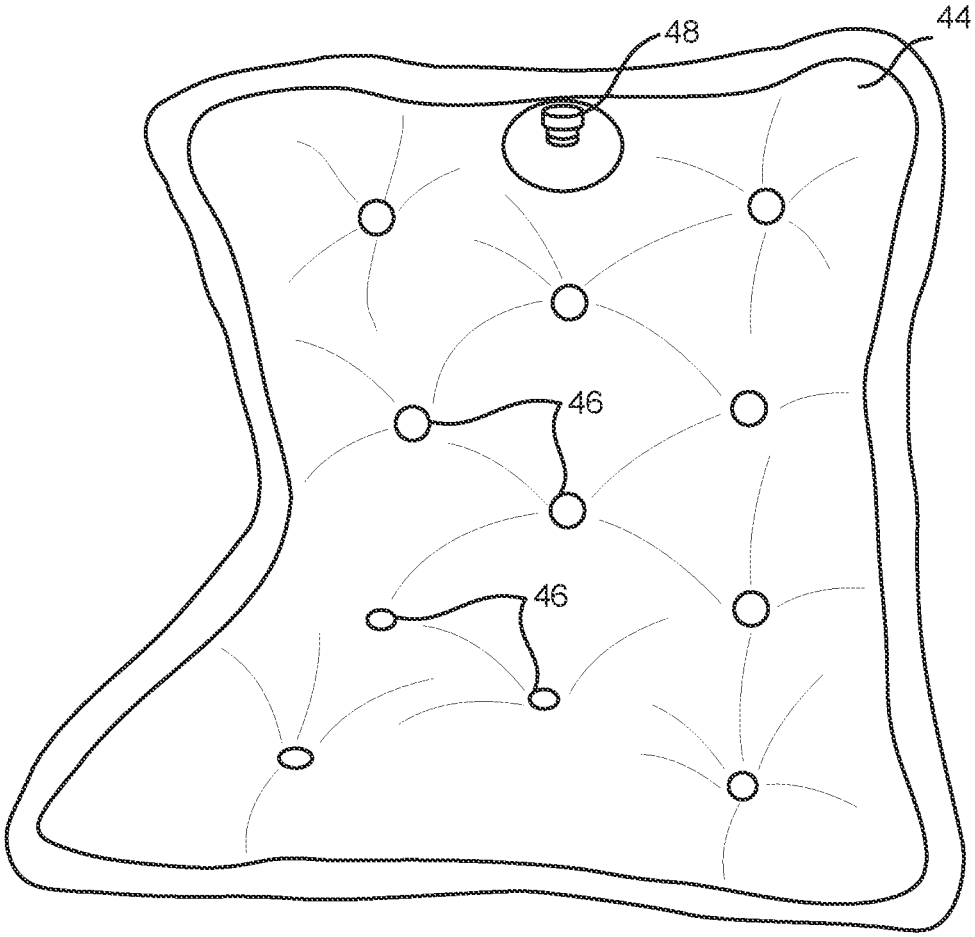
FIG. 7 is an isometric view of an air bladder for use with the a pillow in accordance with an embodiment of the present invention.

Referring to FIG. 7, In some embodiments, the filling for the pillow 10 may be partially or completely embodied by an air bladder 44. For example, the air bladder 44 may be used in combination with another type of filing material such as down, a single piece of foam, or pieces of shredded foam. The air bladder 44 may include fused portions 46 inward from the perimeter thereof to decrease the height of the air bladder 44 when inflated. The air bladder 44 may include a valve 48 for inflating and deflating the air bladder.

Figure 8:
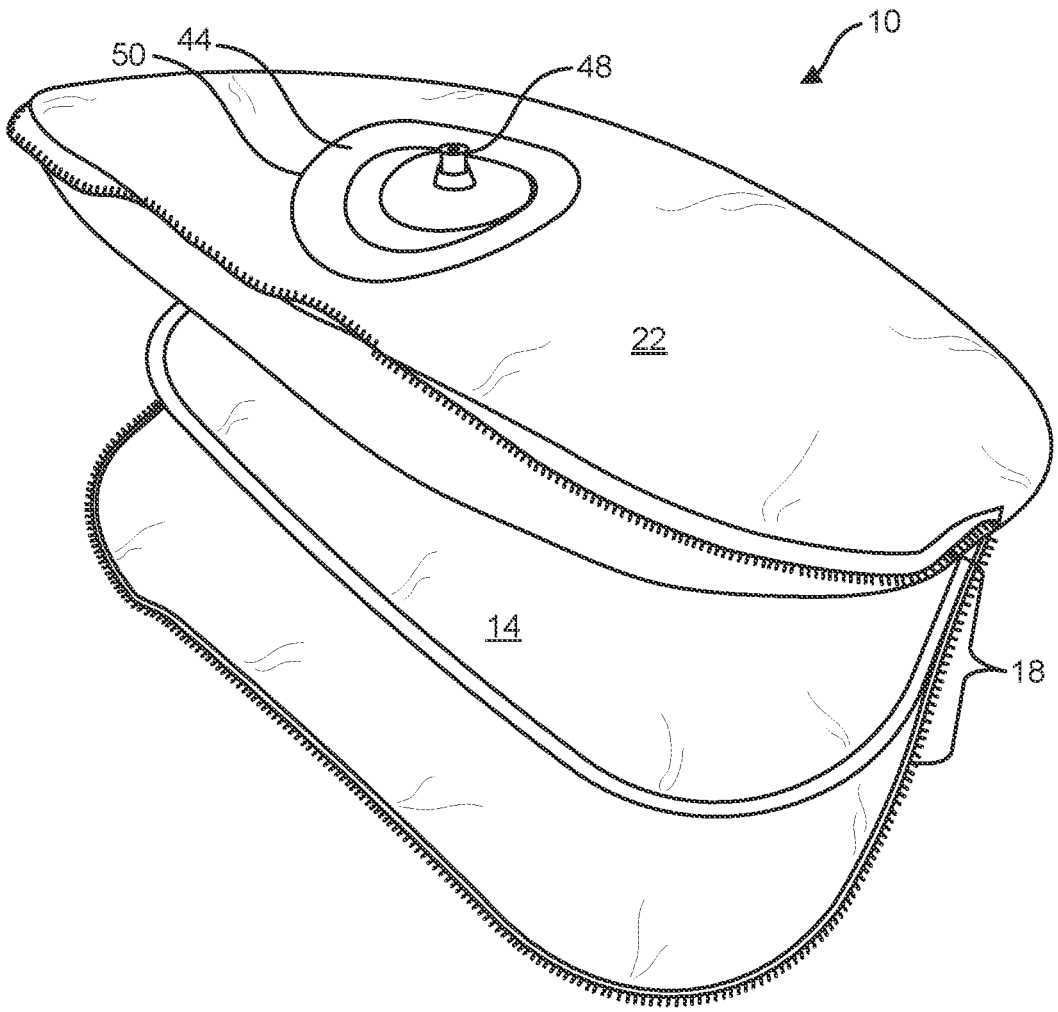
FIG. 8 is an isometric view of a pillow in the stowed configuration with a valve of the air bladder exposed in accordance with an embodiment of the present invention.

Referring to FIG. 8, in some embodiments, the storage case 22 defines an opening 50 through which the valve 48 is accessible. In his manner, when the sleeping case 14 is facing outwardly and the opening 16 is closed, the valve 48 and opening 50 will be inside the pillow 10.

While the preferred embodiments of the invention has been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property or privilege is claimed are defined as follows:

1. A pillow comprising:

a first lobe, a second lobe, and a third lobe extending outwardly from a central node, wherein the third lobe and at least one of the first lobe and the second lobe contain cushioning filling;

wherein a perimeter of the first lobe has a first closure portion secured thereto;

wherein a perimeter of the second lobe has a second closure portion secured thereto and selectively engageable with the first closure portion having the third lobe in either of a sleeping position and a stowed position, the third lobe being positioned between the first lobe and the second lobe when in the stowed position and not positioned between the first lobe and the second lobe when in the sleeping position; and wherein:

the first lobe, the second lobe, and the third lobe are formed of a first surface, a second surface, and a third surface such that:

a first portion of a perimeter of the first surface is joined to a first portion of a perimeter the second surface to form the first lobe;

a second portion of the perimeter of the first surface is joined to a first portion of a perimeter of the third surface to form the second lobe; and a second portion of the perimeter of the second surface is joined to a second portion of the perimeter of the third surface to form the third lobe;

the first surface comprises a first material and the second and third surfaces comprise a second material; and the first material is any one or more of less stretchy, less flexible, and more durable than the second material.

2. The pillow of claim 1, wherein the third lobe is exposed when in the sleeping position and covered by the first lobe and the second lobe when in the stowed position.

3. The pillow of claim 1, wherein the first material is all of less stretchy, less flexible, and more durable than the second material.

4. The pillow of claim 1, wherein:

the first portions and the second portions of the perimeters of all of the first surface, the second surface, and the third surface extend from within 3 mm of a first node to within 3 mm of a second node;

the first closure portion comprises a first portion of a zipper extending along the first portion of the perimeter of the first surface;

the second closure portion comprises a second zipper portion extending along the second portion of the perimeter of the first surface; and the zipper includes a zipper pull, the zipper configured such that the zipper pull is located at the first node when the zipper is completely open and at the second node when the zipper is completely closed.

5. The pillow of claim 1, wherein both of the first lobe and the second lobe contain the cushioning filling.

6. The pillow of claim 1, further comprising a Y-shaped inner pillow case containing the cushioning filling and positioned within the first lobe, second, lobe, and third lobe.

7. The pillow of claim 1, wherein at least a portion of the cushioning filling is an air bladder.

8. The pillow of claim 7, wherein a valve is coupled to the air bladder, a portion of the valve protruding outwardly from the first lobe, the valve being exposed when the third lobe is in the stowed position and the first closure portion is engaged with the second closure portion and covered between the first lobe and the second lobe when the third lobe is in the sleeping position and the first closure portion is engaged with the second closure portion.

9. The pillow of claim 1, wherein the cushioning filling is any of a sheet of foam, shredded foam, and down.

10. A method comprising:

providing a pillow including:

a first lobe, a second lobe, and a third lobe extending outwardly from a central node, wherein the third lobe and at least one of the first lobe and the second lobe contain cushioning filling; and a closure mechanism secured around a perimeter of the first lobe and a perimeter of the second lobe;

closing the closure mechanism with the third lobe in a stowed position, the third lobe contained within the first lobe, second lobe, and closure mechanism in the stowed position;

opening the closure mechanism with the third lobe in the stowed position; and closing the closure mechanism with the third lobe in a sleeping position, the third lobe being exposed and not contained within the first lobe, second lobe, and closure mechanism when in the sleeping position;

wherein:

a first portion of the first lobe and a first portion of the second lobe is exposed and the third lobe is not exposed when the third lobe is in the stowed position and the closure mechanism is closed, the first portion being covered with a first material;

a second portion of the first lobe and a second portion of the second lobe and the third lobe are exposed when the third lobe is in the sleeping position and the closure mechanism is closed, the second portion being covered with a second material;

the first material is any one or more of less stretchy, less flexible, and more durable than the second material;

the second portion of the first lobe faces and contacts the third lobe when in the stowed position;

the second portion of the second lobe faces and contacts the third lobe when in the stowed position; and the first portion of the first lobe and the first portion of the second lobe are joined together between a first node on a first side of the first lobe, the second lobe, and the third lobe and a second node on a second side of the first lobe, the second lobe, and the third lobe by (a) being a single piece of material and (b) a seam.

11. The method of claim 10, wherein the first material is all of less stretchy, less flexible, and more durable than the second material.

12. The method of claim 10, wherein the closure mechanism is a zipper.

13. The method of claim 10, wherein both of the first lobe and the second lobe contain the cushioning filling.

14. The method of claim 10, further comprising a Y-shaped inner pillow case containing the cushioning filling and positioned within the first lobe, second, lobe, and third lobe.

15. The method of claim 10, wherein at least a portion of the cushioning filling is an air bladder, the method further comprising deflating the air bladder.

16. The method of claim 15, wherein:

a valve is coupled to the air bladder, a portion of the valve protruding outwardly from the first lobe, the valve being exposed when the third lobe is in the stowed position; and the method further comprises deflating the air bladder using the valve.

17. The method of claim 10, wherein the cushioning filling is any of a sheet of foam, shredded foam, and down.

* * * * *